US011369833B2

(12) United States Patent
Leipheimer

(10) Patent No.: US 11,369,833 B2
(45) Date of Patent: Jun. 28, 2022

(54) REMOVABLE LAT PULL-DOWN SEAT FOR AN EXERCISE SYSTEM

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 188 days.

(21) Appl. No.: 16/744,685

(22) Filed: Jan. 16, 2020

(65) Prior Publication Data

US 2020/0222745 A1 Jul. 16, 2020

Related U.S. Application Data

(60) Provisional application No. 62/793,119, filed on Jan. 16, 2019.

(51) Int. Cl.
*A63B 21/00* (2006.01)
*A63B 21/072* (2006.01)
(Continued)

(52) U.S. Cl.
CPC ..... *A63B 21/4029* (2015.10); *A63B 21/0628* (2015.10); *A63B 21/078* (2013.01);
(Continued)

(58) Field of Classification Search
CPC ... A63B 17/00; A63B 17/04; A63B 21/00058; A63B 21/00061; A63B 21/00065;
(Continued)

(56) References Cited

U.S. PATENT DOCUMENTS 5,554,083 A * 9/1996 Chen ..... A63B 21/00181 482/138
6,299,568 B1 * 10/2001 Prok ..... A63B 23/00 482/104

(Continued)

OTHER PUBLICATIONS

King of the Gym ("Installing Lat Pulldown Seat on Force USA MyRack Cable Crossover Attachment" YouTube video at https://www.youtube.com/watch?v=VdEhdeGby14, dated Sep. 20, 2018) (Year: 2018).*

(Continued)

*Primary Examiner* — Gary D Urbiel Goldner
(74) *Attorney, Agent, or Firm* — The Webb Law Firm

(57) ABSTRACT

An exercise machine may include a support frame with a first and second column; a plurality of guide members movably mounted along both columns; and at least one attachment detachably mounted onto either column, thereby securing the at least one attachment to the support frame. The at least one attachment may include a first portion; a second portion extending from the first portion; and a locking mechanism extending from the second portion. The locking mechanism may include at least one stationary locking pin received by either column; and a movable locking pin configured to be received by either column. The at least one attachment is detachably mounted onto either column simultaneously with the plurality of guide members, and at least one of the plurality of guide members positions an operative portion of a weight arrangement at a location along the support frame.

16 Claims, 9 Drawing Sheets

(51) Int. Cl.
*A63B 21/078* (2006.01)
*A63B 21/062* (2006.01)

(52) U.S. Cl.
CPC ..... *A63B 21/0724* (2013.01); *A63B 21/4034* (2015.10); *A63B 21/4035* (2015.10); *A63B 21/4039* (2015.10); *A63B 2225/09* (2013.01); *A63B 2225/10* (2013.01)

(58) Field of Classification Search
CPC ..... A63B 21/00069; A63B 21/062; A63B 21/0622; A63B 21/0624; A63B 21/0626; A63B 21/0628; A63B 21/063; A63B 21/0632; A63B 21/072; A63B 21/0724; A63B 21/075; A63B 21/078; A63B 21/0783; A63B 21/15; A63B 21/151; A63B 21/154; A63B 21/156; A63B 21/16; A63B 21/4027; A63B 21/4029; A63B 21/4033; A63B 21/4034; A63B 21/4035; A63B 21/4039; A63B 21/4043; A63B 21/4045; A63B 23/035; A63B 23/03516; A63B 23/03525; A63B 23/0355; A63B 23/03558; A63B 23/03566; A63B 23/12; A63B 23/1209; A63B 23/1218; A63B 23/1245; A63B 23/1272; A63B 2208/0228; A63B 2208/0233; A63B 2208/0238; A63B 2210/00; A63B 2210/50; A63B 2225/09; A63B 2225/093; A63B 2225/10; A63B 2225/102; A63B 2225/105; A63B 2225/107; A63B 2244/09
See application file for complete search history.

(56) References Cited

U.S. PATENT DOCUMENTS

| | | | | |
|---|---|---|---|---|
| 6,755,770 | B2 | 6/2004 | Martens | |
| 7,070,546 | B1 | 7/2006 | Grasso | |
| 10,486,010 | B1 | 11/2019 | Leipheimer | |
| 2017/0007877 | A1* | 1/2017 | Leipheimer | A63B 21/078 |
| 2017/0246496 | A1* | 8/2017 | Nelson | A63B 21/0783 |
| 2018/0243597 | A1* | 8/2018 | Schlegel | A63B 71/023 |
| 2020/0069988 | A1* | 3/2020 | Gore | A63B 21/00065 |
| 2021/0170218 | A1* | 6/2021 | Lewis-Dove | A63B 21/00 |

OTHER PUBLICATIONS

King of the Gym ("Removing Lat Pulldown Seat from Force USA MyRack Cable Crossover Attachment" YouTube video at https://www.youtube.com/watch?v=fg_JgUKP_68, dated Sep. 19, 2018) (Year: 2018).*

King of the Gym ("In-Depth Look at the Force USA MyRack Power Rack with ALL Attachments" YouTube video at https://www.youtube.com/watch?v=HFwvvAp7z-A, dated Sep. 20, 2018) (Year: 2018).*

King of the Gym ("Lat Pulldowns on Force USA MyRack Cable Crossover Attachment" YouTube video https://www.youtube.com/watch?v=Omw1CGXb0g8, dated Sep. 20, 2018) (Year: 2018).*

Force USA, Monster G3 Lat Pull Down Seat Attachment, https://www.forceusa.com/products/monster-g3-lat-pull-down-seat-attachment (last accessed Mar. 6, 2020), Net Media Group, LLC (last accessed Apr. 7, 2020).

* cited by examiner

REMOVABLE LAT PULL-DOWN SEAT FOR AN EXERCISE SYSTEM

CROSS-REFERENCE TO RELATED APPLICATION

The present application claims priority to United States Provisional Application No. 62/793,119, filed Jan. 16, 2019, the disclosure of which is hereby incorporated by reference in its entirety.

BACKGROUND OF THE INVENTION

Field of the Invention

This disclosure relates generally to exercise or weight machines and, more particularly, to an attachment that is capable of being mounted to a portion of the exercise machine.

Description of Related Art

Various exercise machines for strength training and conditioning have been developed, including machines that utilize a weight stack and pulley arrangement to provide resistance to an exercising motion by a user. These machines use support columns to organize the associated cables, pulleys, exercise handles, and other equipment used.

Many conventional exercise machines fail to provide versatile, all-in-one systems that allow a user to perform multiple exercises on the same equipment. For example, many exercise machines provide handles that are movable in a vertical direction. Other exercise machines provide seats that are integral to the exercise machine. However, with an integral seat, a user is prevented from doing exercises, such as curls or shoulder raises, where the movable handle is required to be in its bottommost position. Further, many exercise machines are designed for use in areas that are smaller than a traditional gym; for example, a home or apartment. With these reduced areas, it has become increasingly important to conserve space by reducing the size of exercise machines. This reduced area arrangement for exercise machines is accomplished by providing multiple attachments that can be attached to the exercise machine along a shared column with the movable exercise handle.

SUMMARY OF THE INVENTION

One embodiment or aspect of the present disclosure may be an exercise machine which may include a support frame including a first column and a second column; a plurality of guide members configured to be movably mounted along the first column or the second column; and at least one attachment configured to be detachably mounted onto the first column or the second column, thereby securing the at least one attachment to the support frame. The at least one attachment may be configured to be detachably mounted onto the first column or the second column, thereby securing the at least one attachment to the support frame. The at least one attachment may include a first portion; a second portion extending from the first portion; and a locking mechanism extending from the second portion. The locking mechanism may include at least one stationary locking pin configured to be received by the first or the second column; and a movable locking pin configured to be received by the first or the second column. The at least one attachment may be detachably mounted onto the first column or the second column simultaneously with the plurality of guide members, and at least one of the plurality of guide members may be configured to position an operative portion of a weight arrangement at a location along the support frame.

In another embodiment or aspect of the present disclosure, the first portion may include a seat. The first portion may include at least one adjustable leg roller. The first portion may include at least one foot plate. The first column and the second column may include a plurality of holes configured to receive at least a portion of the plurality of guide members and at least a portion of the locking mechanism therethrough. The plurality of holes may be one inch in diameter. The movable locking pin may be displaceable between a locking position and an opening position.

In another aspect or embodiment of the present disclosure, upon displacing the movable locking pin from the locking position to the opening position, the at least one stationary locking pin may be received through a first hole, permitting the locking mechanism to be rotatably mounted to the first column or the second column. Upon rotatably mounting the locking mechanism to the portion of the support frame, the movable locking pin may be displaced from the opening position to the locking position and received through the second hole, thereby securing the locking mechanism to the first column or the second column. The movable locking pin may include a gripping portion configured to permit a user to displace the movable locking pin between the locking position and the opening position.

In another embodiment or aspect, the locking mechanism may include a safety hook configured to surround at least a portion of the first column or the second column when the locking mechanism is secured to the portion of the support frame. The safety hook may include a first end face and a second end face opposing the first end face, wherein the at least one stationary locking pin extends from a surface of the first end face and the movable locking pin extends from a surface of the second end face. The movable locking pin may be displaceable within and irremovable from the second end of the safety hook. The first column may oppose the second column by at least 40 inches.

In another embodiment or aspect of the present disclosure, the plurality of guide members may include a first J-hook movably mounted to the first column and a second J-hook movably mounted to the second column. The weight arrangement may include a barbell; and a plurality of weight plates configured to be slidably mounted to the barbell. At least a portion of the barbell is received on the first J-hook and the second J-Hook. The weight arrangement may include a handle; an exercise cable having a first end and a second end, the first end being connected to the handle and the second end being connected to a portion of the support frame; and at least one movable weight rack operatively connected to the exercise cable. Upon pulling the handle, the at least one movable weight rack may move a distance, and the plurality of guide members position the handle and exercise cable at a desired location along the first column or the second column.

In another embodiment or aspect of the present disclosure, an attachment configured to be detachably mounted onto a column of an exercise machine may include a first portion configured to be engaged by a user; a second portion extending from the first portion; and a locking mechanism extending from the second portion, the locking mechanism may include at least one stationary locking pin configured to be received by the column; and a movable locking pin configured to be received by the column. The at least one stationary locking pin may extend from the locking mechanism in a first direction and the movable locking pin extends from the locking mechanism in a second direction, opposite the first direction, and at least one guide member may be configured to be received by the column simultaneously with the attachment.

In another embodiment or aspect of the present disclosure, a method of securing a first attachment to a column of a support frame of an exercise machine may include the steps of placing a stationary pin of the first attachment through a first hole of the column; displacing a movable locking pin of the first attachment from a locking position to an open position; rotating the first attachment about the column; and releasing the movable locking pin so as to permit the movable locking pin to move from the open position to the locking position. After releasing the movable locking pin, at least a portion of the movable locking may be received through a second hole of the column. At least one second attachment may be movably mounted to the column simultaneously with the first attachment. At least a portion of the first attachment may be configured to engage a user. The first attachment may include at least of a seat or a foot plate.

Further non-limiting embodiments or aspects are set forth in the following numbered clauses Clause 1: An exercise machine, comprising: a support frame; a handle; at least one guide member slidably mounted along a portion of the support frame, the support frame comprising a first column; and a second column; a plurality of guide members configured to be movably mounted along the first column or the second column; and at least one attachment configured to be detachably mounted onto the first column or the second column, thereby securing the at least one attachment to the support frame, the at least one attachment comprising: a first portion; a second portion extending from the first portion; and a locking mechanism extending from the second portion, the locking mechanism comprising: at least one stationary locking pin configured to be received by the first or the second column; and a movable locking pin configured to be received by the first or the second column, wherein the at least one attachment is detachably mounted onto the first column or the second column simultaneously with the plurality of guide members, and wherein at least one of the plurality of guide members are configured to position an operative portion of a weight arrangement at a location along the support frame.

Clause 2: The exercise machine of clause 1, wherein the first portion comprises a seat.

Clause 3: The exercise machine of clause 1 or 2, wherein the first portion comprises at least one adjustable leg roller.

Clause 4: The exercise machine of any of clauses 1-3, wherein the first portion comprises at least one foot plate.

Clause 5: The exercise machine of any of clauses 1-4, wherein the first column and the second column include a plurality of holes configured to receive at least a portion of the plurality of guide members and at least a portion of the locking mechanism therethrough.

Clause 6: The exercise machine of any of clauses 1-5, wherein the plurality of holes are one inch in diameter.

Clause 7: The exercise machine of any of clauses 1-6, wherein the movable locking pin is displaceable between a locking position and an opening position.

Clause 8: The exercise machine of any of clauses 1-7, wherein upon displacing the movable locking pin from the locking position to the opening position, the at least one stationary locking pin is received through a first hole, permitting the locking mechanism to be rotatably mounted to the first column or the second column.

Clause 9: The exercise machine of any of clauses 1-8, wherein upon rotatably mounting the locking mechanism to the first column or the second column, the movable locking pin is displaced from the opening position to the locking position and received through a second hole, thereby securing the locking mechanism to the first column or the second column.

Clause 10: The exercise machine of any of clauses 1-9, wherein the movable locking pin comprises a gripping portion configured to permit a user to displace the movable locking pin between the locking position and the opening position.

Clause 11: The exercise machine of any of clauses 1-10, wherein the locking mechanism comprises a safety hook configured to surround at least a portion of the first column or the second column when the locking mechanism is secured to the first column or the second column.

Clause 12: The exercise machine of any of clauses 1-11, wherein the safety hook comprises a first end having a first end face and a second end having a second end face, the second end face opposing the first end face, wherein the at least one stationary locking pin extends from a surface of the first end face and the movable locking pin extends from a surface of the second end face.

Clause 13: The exercise machine of any of clauses 1-12, wherein the movable locking pin is displaceable within and irremovable from the second end of the safety hook.

Clause 14: The exercise machine of any of clauses 1-13, wherein the first column opposes the second column by at least 40 inches.

Clause 15: The exercise machine of any of clauses 1-14, wherein the plurality of guide members comprises a first J-hook movably mounted to the first column and a second J-hook movably mounted to the second column.

Clause 16: The exercise machine of any of clauses 1-15, wherein the weight arrangement comprises: a barbell; and a plurality of weight plates configured to be slidably mounted to the barbell, wherein at least a portion of the barbell is received on the first J-hook and the second J-hook.

Clause 17: The exercise machine of any of clauses 1-16, wherein the weight arrangement comprises: a handle; an exercise cable having a first end and a second end, the first end being connected to the handle and the second end being connected to a portion of the support frame; and at least one movable weight rack operatively connected to the exercise cable, wherein, upon pulling the handle, the at least one movable weight rack moves a distance, and wherein the plurality of guide members position the handle and exercise cable at a desired location along the first column or the second column.

Clause 18: An attachment configured to be detachably mounted onto a column of an exercise machine, the attachment comprising: a first portion configured to be engaged by a user; a second portion extending from the first portion; and a locking mechanism extending from the second portion, the locking mechanism comprising: at least one stationary locking pin configured to be received by the column; and a movable locking pin configured to be received by the column, wherein the at least one stationary locking pin extends from the locking mechanism in a first direction and the movable locking pin extends from the locking mechanism in a second direction, opposite the first direction, and wherein at least one guide member is configured to be received by the column simultaneously with the attachment.

Clause 19: A method of securing a first attachment to a portion of a support frame of an exercise machine, the method comprising the steps of: placing a stationary pin of the first attachment through a first hole of the support frame; displacing a movable locking pin of the first attachment from a locking position to an open position; rotating the first attachment about the support frame; and releasing the movable locking pin so as to permit the movable locking pin to move from the open position to the locking position, wherein after releasing the movable locking pin, at least a portion of the movable locking pin is received through a second hole of the support frame, wherein at least one second attachment is secured to the same portion of the support frame as the first attachment, and wherein at least a portion of the first attachment is configured to engage a user.

Clause 20: The method of clause 19, wherein the first attachment comprises at least one of a seat or a foot plate.

DETAILED DESCRIPTION OF THE PREFERRED EMBODIMENTS

Figure 1:
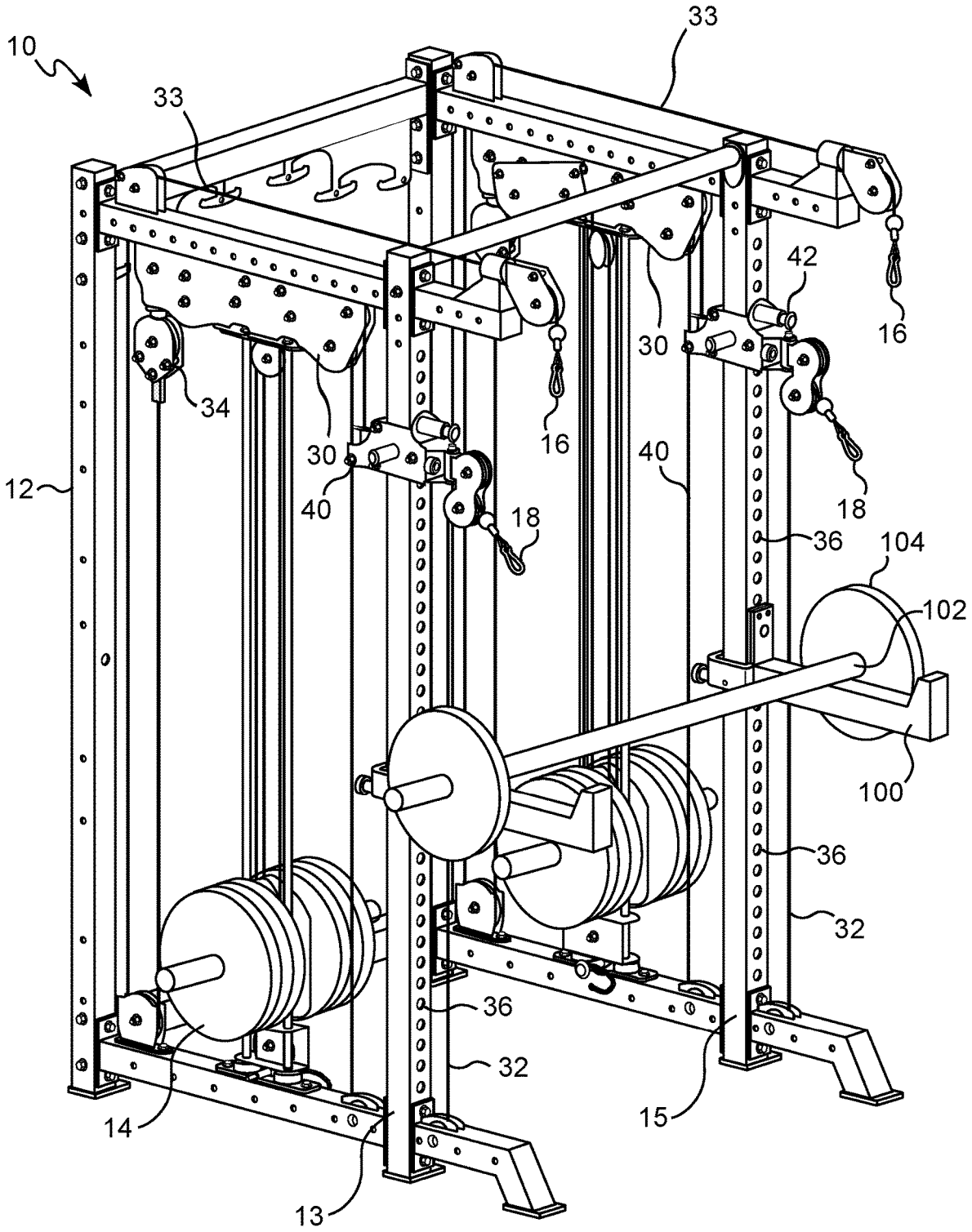
FIG. 1 is a front perspective view of an exercise machine.
Figure 2:
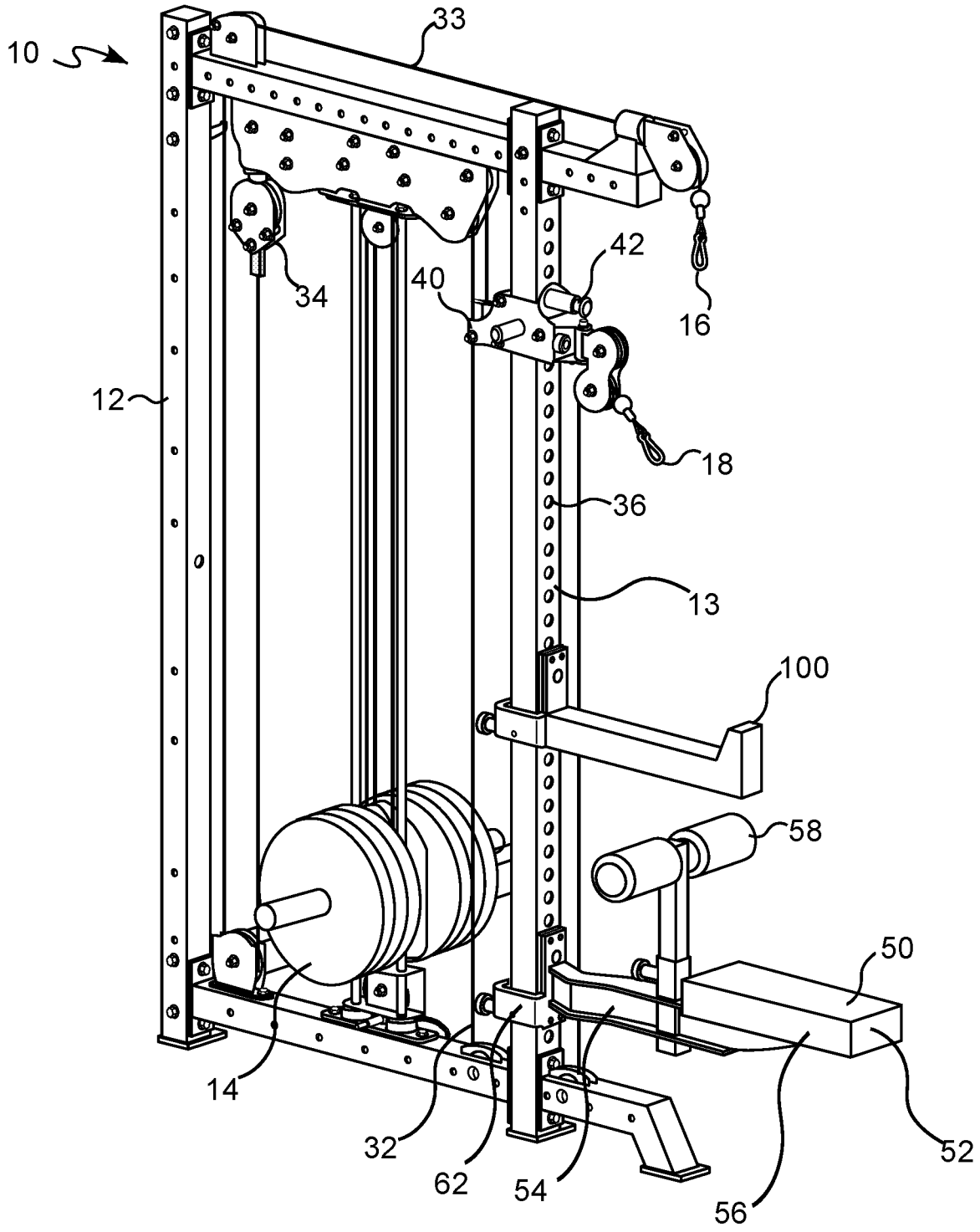
FIG. 2 is a partial perspective view of the exercise machine of FIG. 1 having an attachment mounted thereto according to the present disclosure.

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings, and described in the following specification, are simply exemplary aspects of the disclosure. Hence, specific dimensions and other physical characteristics related to the aspects disclosed herein are not to be considered as limiting.

The present disclosure is directed to, in general, an exercise or weight machine and, more particularly, to a weight ratio arrangement that allows a user to vary a mechanical advantage provided by traditional pulley arrangements on the exercise or weight machines. Certain aspects of the components of the exercise or weight machine and the weight ratio arrangement are illustrated in FIGS. 1-7.

With reference to FIGS. 1, and 5A-7, an exercise machine 10 (also referred to as a weight machine or weightlifting machine) which includes several different exercise stations is shown. The exercise machine 10 includes a support frame 12 that houses several different components of the exercise machine 10, including a weight stack 14. The exercise machine 10 and support frame 12 includes at least two columns 13, 15. It should be understood that although one configuration of a support frame is illustrated in the disclosed embodiment, other configurations of the support frame will be equally suitable for use with the present disclosure. For example, as shown, the support frame 12 is generally a rectangular parallelpiped shape; however it may be triangular prism, a hexagonal prism or another shape conducive to a user 5 using the exercise machine 10 may be used.

Figure 7:
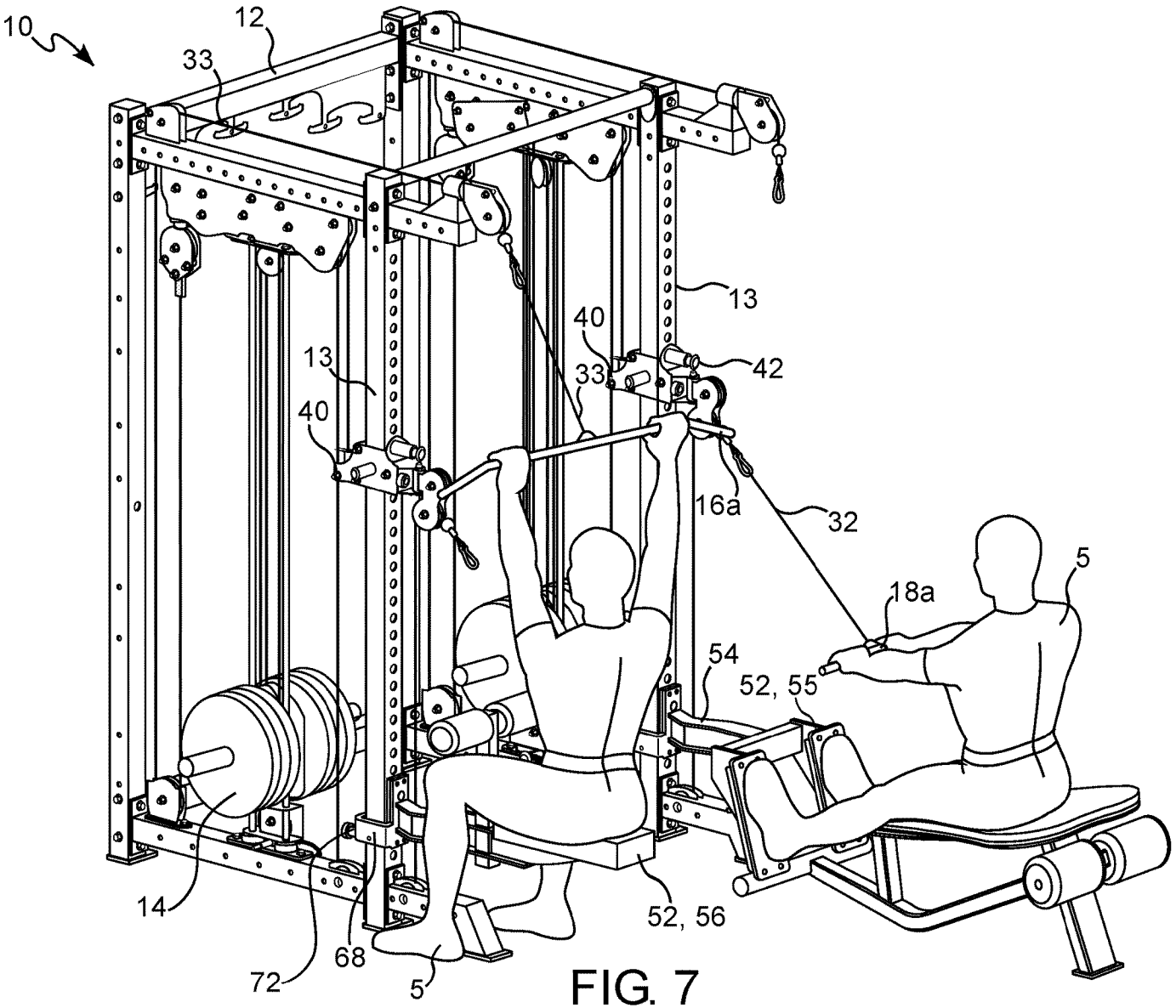
FIG. 7 is a perspective view of the exercise machine of FIG. 1 having the attachments of FIG. 2 and FIG. 3 mounted thereto with users engaging the exercise machine and attachment.

In one exercise station, connectors 16, 18 for use with different exercise handles are provided to permit different types of exercises to be performed by different users 5. As shown in FIG. 7, a lat bar 16*a* and an exercise handle 18*a* are linked to the connectors 16, 18 and may be provided to the users 5. It is contemplated that other exercise handles or equipment, such as a rope, curl bar, tricep bar, and other equipment known to those having skill in the art may be attached to either connector. The user(s) 5 may pull on the lat bars 16*a* and the exercise handles 18*a*, as will be described below, to pull a load supplied by the weight stack 14 for exercising. As shown in FIG. 7, multiple users 5 may engage the exercise machine 10 at one time.

A weight ratio arrangement 30 may be used in the exercise machine 10. The weight ratio arrangement 30 includes an exercise cable 32 and a plurality of pulleys 34 (only one is labeled for clarity). A first end of the exercise cable 32 is connected to the connector 18 and its respective handle 18*a*. A second opposing end of the exercise cable 32 may be connected to a pulley block or a portion of the support frame 12. The exercise cable 32 is operatively connected to the weight stack 14 so that when a user 5 pulls on the exercise handle 18*a*, the weight stack 14 moves and thereby provides resistance to the user 5. A second exercise cable 33 may also be used with the weight ratio arrangement 30. This exercise cable 33 has a first end connected to the connector 16 and a second end connected to a pulley block or a portion of the support frame 12. When a user 5 pulls on the lat bar 16*a*, the weight stack 14 moves and thereby provides resistance to the user 5. The plurality of pulleys 34 may be arranged within the exercise machine 10 so as to engage with either exercise cable 32, 33 and the weight stack 14 in specific ways in order to provide different levels of resistance to the user 5. Various arrangements of the plurality of pulleys 34 and exercise cables 32, 33 are described in U.S. Pat. No. 10,486,010, the disclosure of which is incorporated in its entirety by reference.

To help a user 5 perform a desired workout, guiding attachments 40 may be mounted to a portion of the support frame 12. The guiding attachments 40 can help position the exercise cable 32, the connector 18, and exercise handle 18*a* at a desired location along the support frame 12 depending on the exercise a user 5 desires to perform. The guiding attachment may be placed on the columns 13, 15 of the support frame 12 and be slidable in the vertical direction. The columns 13, 15 may have a plurality of holes 36 (not all holes are labeled for clarity purposes) along one or more sides. It is contemplated that the holes may be any size suitable for their engagement in exercise or weight lifting activities, such as ⅝ inches or 1 inch in diameter.

As shown, the plurality of holes 36 extend through the columns 13, 15 so that a hole 36 on one side of the columns 13, 15 corresponds to a hole 36 on the opposing side. The holes receive a pin 42, connected to the guiding attachments 40, therethrough. The pin 42 is movable between a locked position where it is received by one of the holes 36 and an open position where it is not. By moving the pin 42 to the open position, the guiding attachments 40 may slide vertically along the columns 13, 15 of the support frame 12 until it is in a desired location. At that point, the pin 42 may be moved to the locked position in order to secure the guiding attachments 40 to the columns 13, 15.

It is contemplated that other attachments such as a J-hook 100 may be attached to the columns 13, 15 via the holes 36 as well. In these instances, the J-hooks 100 attach to the columns 13, 15 in a manner known to those having skill in the art. One J-hook 100 may attach to each column 13, 15 at an equal distance above the ground. In this configuration, a barbell 102 may rest on each J-hook and be supported between the columns 13, 15. This permits plated weights 104 to be slidably mounted onto the barbell 102 and permit a user to engage with the barbell 102 and weights 104 at a desired height above the ground. The J-hooks 100 may be placed at any height a user desires so long as the J-hooks 100 properly interact with the holes 36 and are safely connected to the columns 13, 15. The guiding attachments 40 may be displaced along the columns 13, 15 so that they do not interfere with the use of the barbell 102 when the J-hooks 100 are in use. As shown in FIGS. 1, and 5A-6, both the J-hooks 100 and guiding attachments 40 may engage with the support frame 12 simultaneously. In order to accommodate the J-hooks 100 and barbell 102, the columns 13, 15 may be placed at a desired distance apart from each other. For example, column 13 may be placed at least 40 inches apart from column 15. In another example, column 13 may be placed at least 46 inches apart from column 15.

Unlike the guiding attachment 40, the J-hooks 100 may completely disengage the support frame 12, columns 13, 15, and the plurality of holes 36 when a user desires to reposition the J-hooks 100 at a new location along the columns 13, 15. In other words, instead of being slidably mounted to the columns 13, 15 and/or support frame 12 like the guiding attachment 40, the J-hooks 100 are removably or detachably mounted to the columns 13, 15 and/or support frame 12. While the guiding attachments 40 and J-hooks 100 are described here, it is contemplated that other attachments known to those having skill in the art, such as a barbell safety catch, may be mounted to the columns 13, 15 in place of the guiding attachments 40 and J-hooks 100.

Referring now to FIGS. 2-7, an arrangement for an attachment 50 to the exercise machine 10 is described according to the present embodiment. While the attachment 50 is described as attaching to the exercise machine 10, it is contemplated that the attachment 50 can be attached to any exercise equipment utilizing a similar support column structure as described herein. The attachment 50 can be attached to either column 13, 15 while the guiding attachments 40 and the J-hooks 100 are also attached to their respective columns 13, 15. In this configuration, the exercise machine 10 saves space by allowing a user 5 to perform various exercises while only utilizing one support frame 12 upon which various weight lifting components can be simultaneously attached or utilized.

Figure 3:
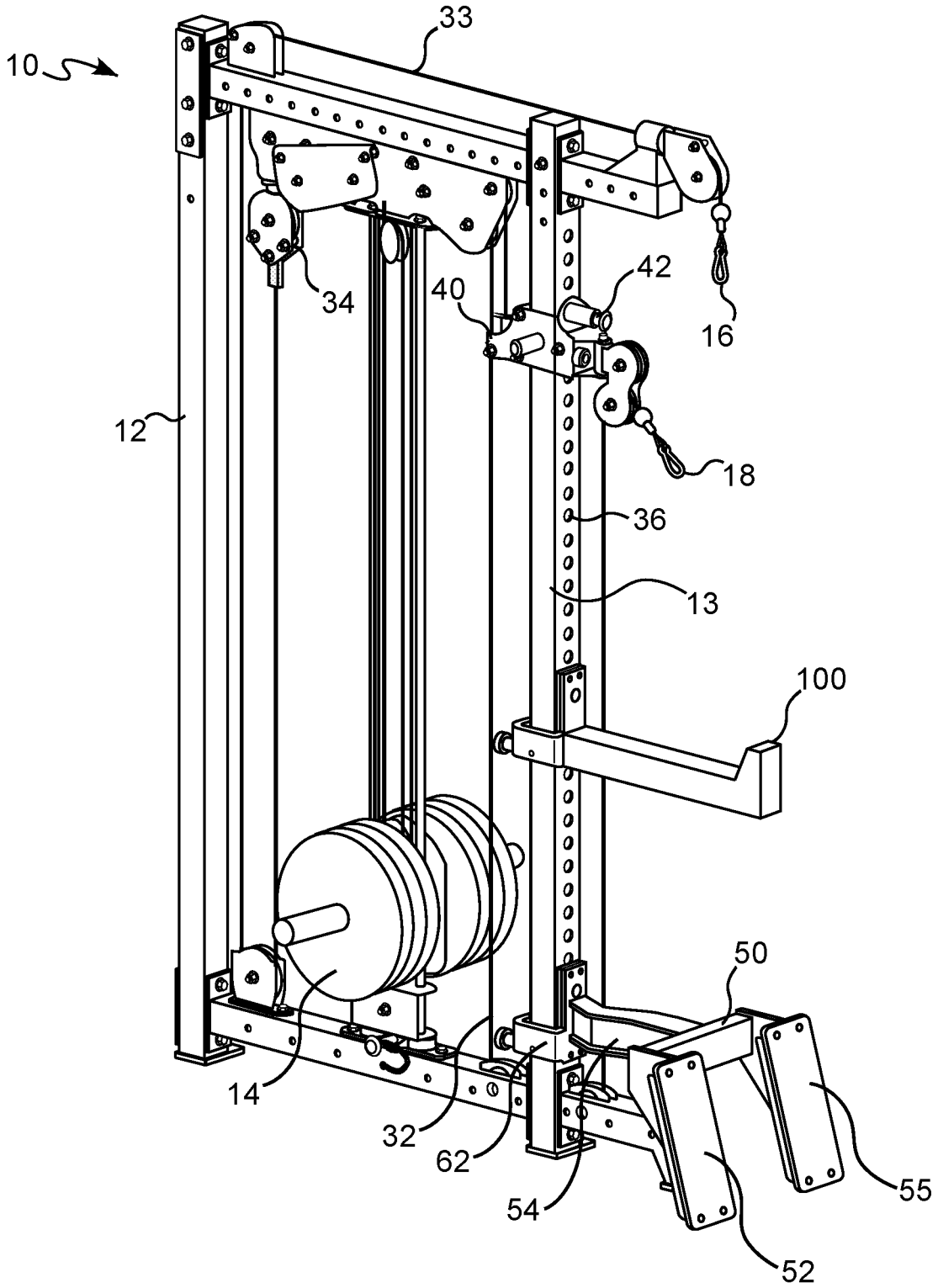
FIG. 3 is a partial perspective view of the exercise machine of FIG. 1 having an attachment mounted thereto according to another aspect of the present disclosure.
Figure 5A:
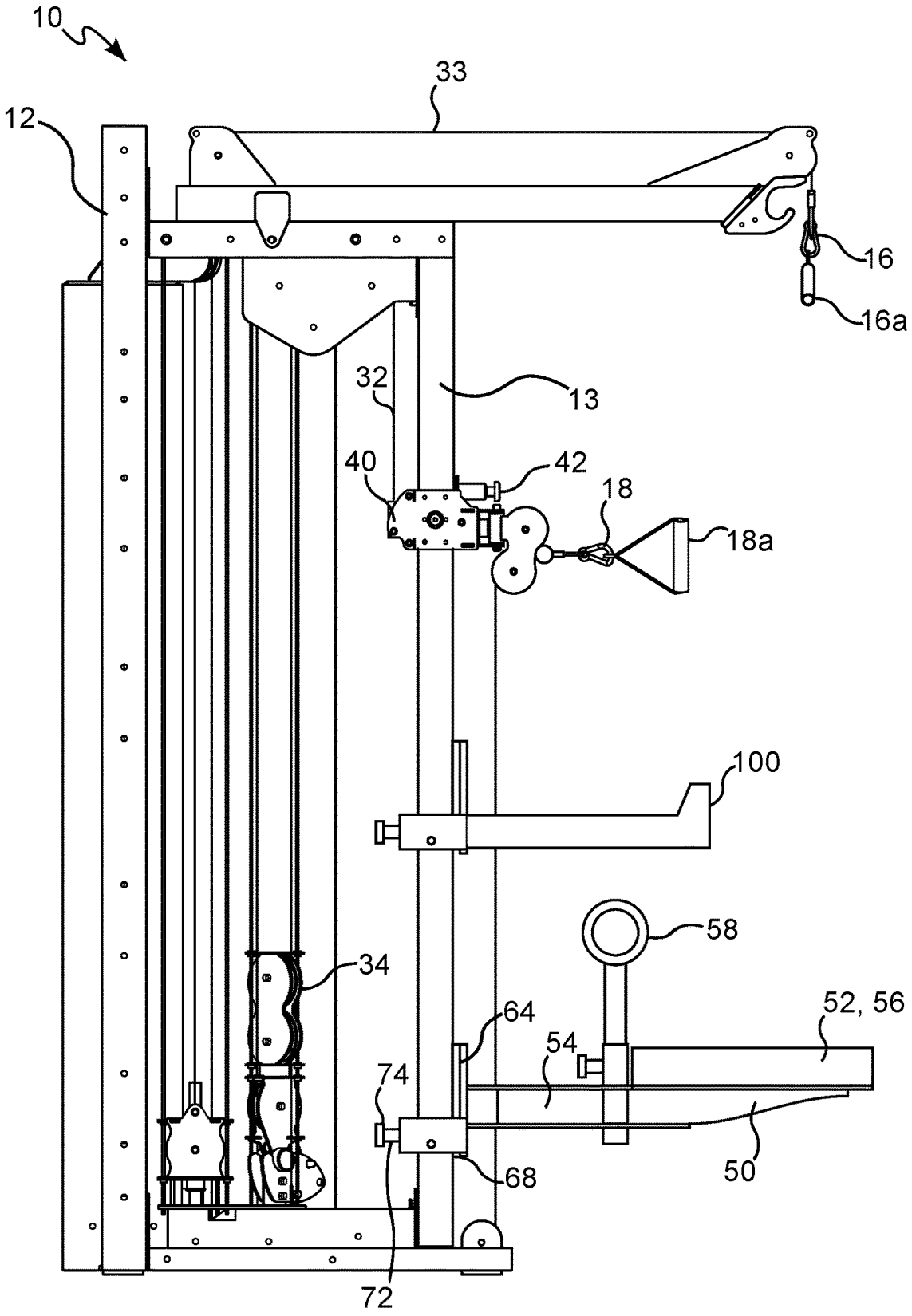
FIG. 5A is a side view of the attachment of FIG. 2 mounted to the exercise machine of FIG. 1.
Figure 5B:
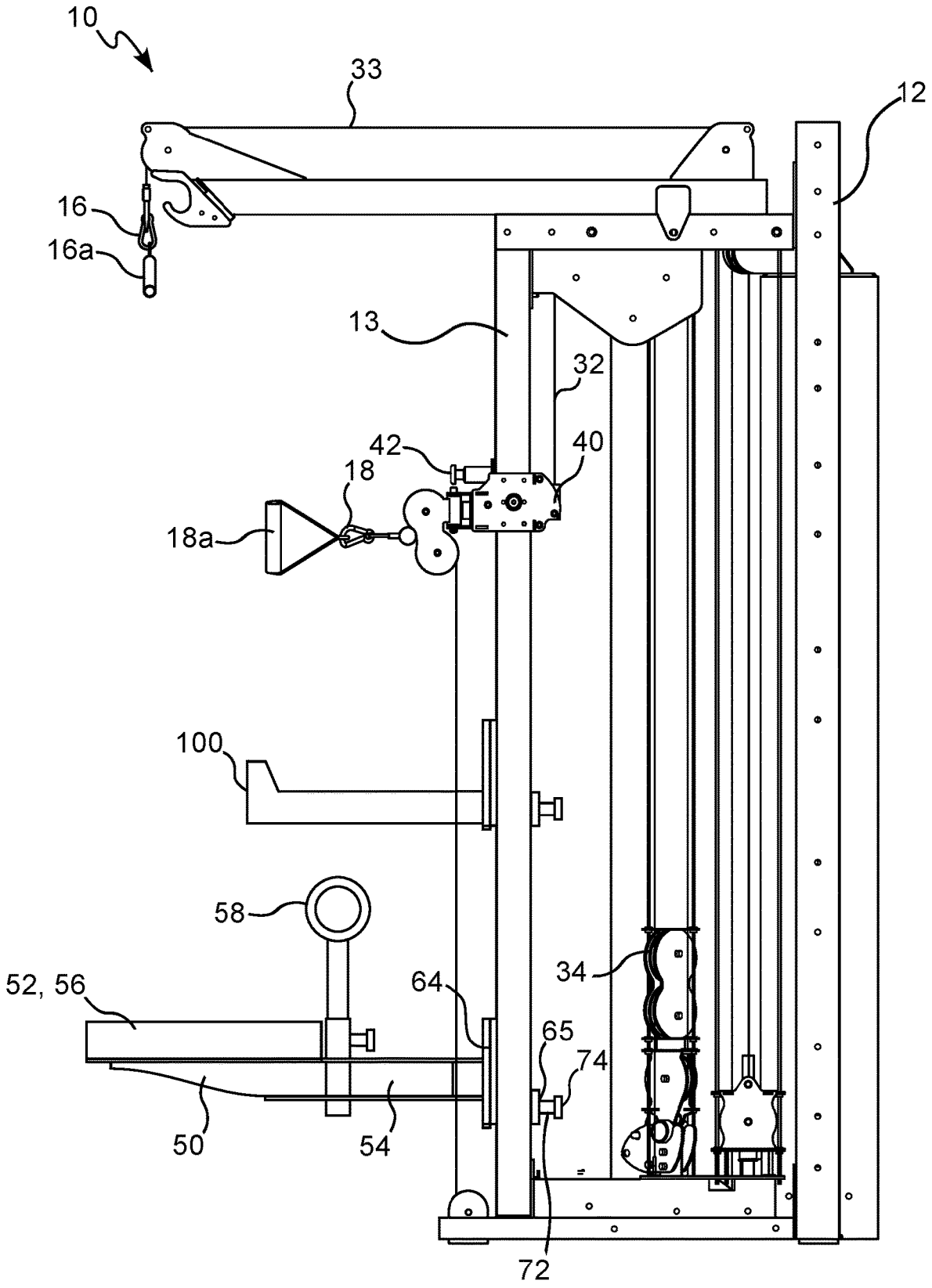
FIG. 5B is a side view of the attachment of FIG. 2 mounted to the exercise machine of FIG. 1.
Figure 6:
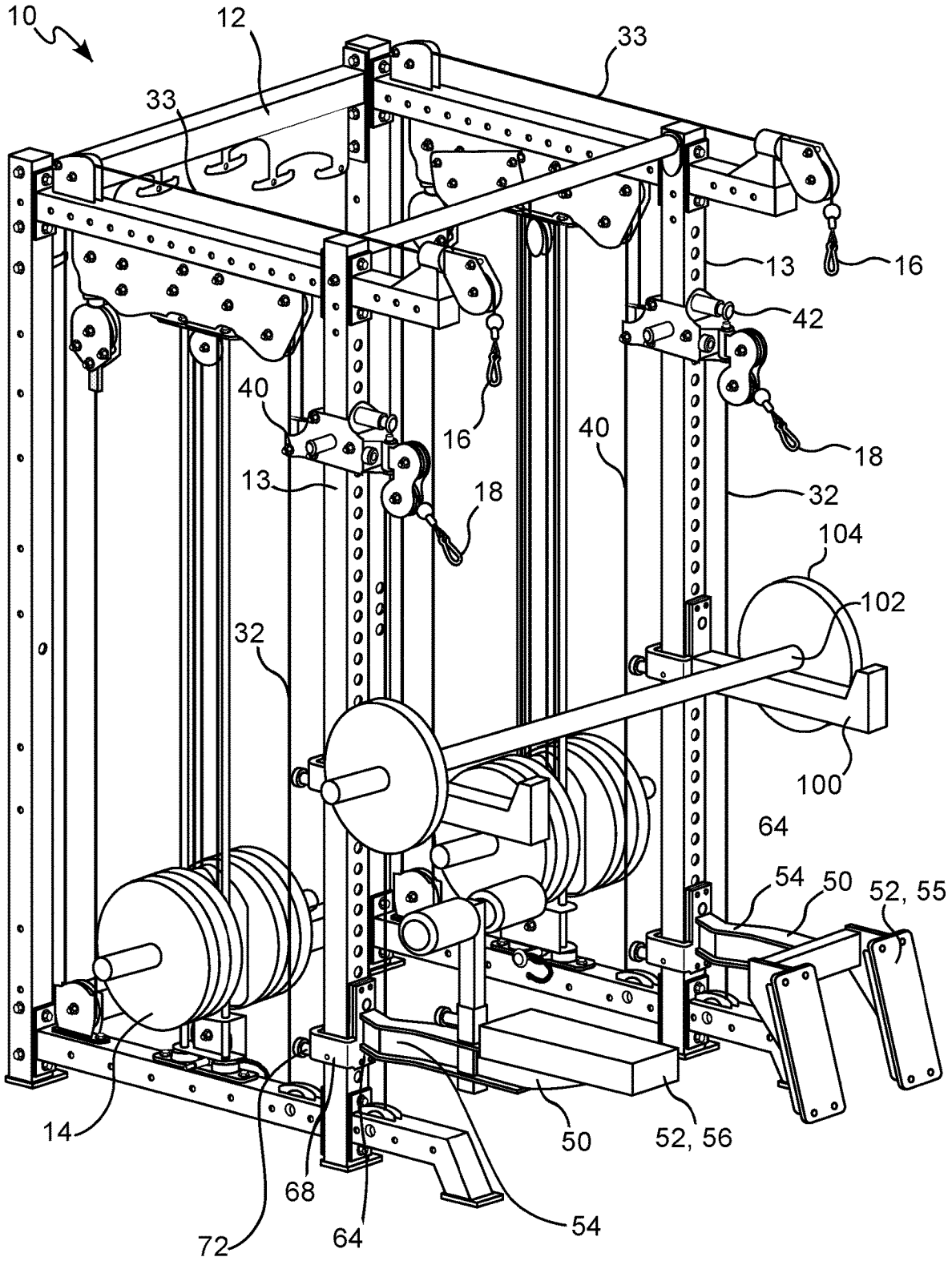
FIG. 6 is a perspective view of the exercise machine of FIG. 1 having the attachments of FIG. 2 and FIG. 3 mounted thereto.

The attachment 50 may have a first portion 52 and a second portion 54 extending from the first portion 52. The first portion 52 may be designed to be engaged by a user 5 of the exercise machine 10. As shown in FIGS. 2, and 4A-7, the first portion 52 may include a seat 56 and adjustable leg rollers 58 for a user 5 conducting exercises with the lat bar 16*a*. As shown in FIGS. 3, 6, and 7, the first portion 52 is a foot plate 55. It is contemplated that the first portion may also be any number of accessories that facilitate use of the exercise machine 10 in various ways. Examples of accessories may include, but are not limited to, a back bench, a seat with a chest support, or a seat with an arm-press system.

The second portion 54 of the attachment 50 extends from the first portion 52 and may have a distal end 60 located farthest away from the first portion 52. A locking mechanism 62 may extend from the distal end 60 in order to secure the attachment 50 to the support frame 12 of the exercise machine 10. The locking mechanism 62 may engage with the plurality of holes 36 on the columns 13, 15 of the support frame 12. The column 12 may have one upper hole 36*a* and a lower hole 36*b*. The locking mechanism 62 may engage with the columns 13, 15, upper hole 36*a*, and lower hole 36*b* in order to secure the attachment 50 to the exercise machine 10.

Figure 4A:
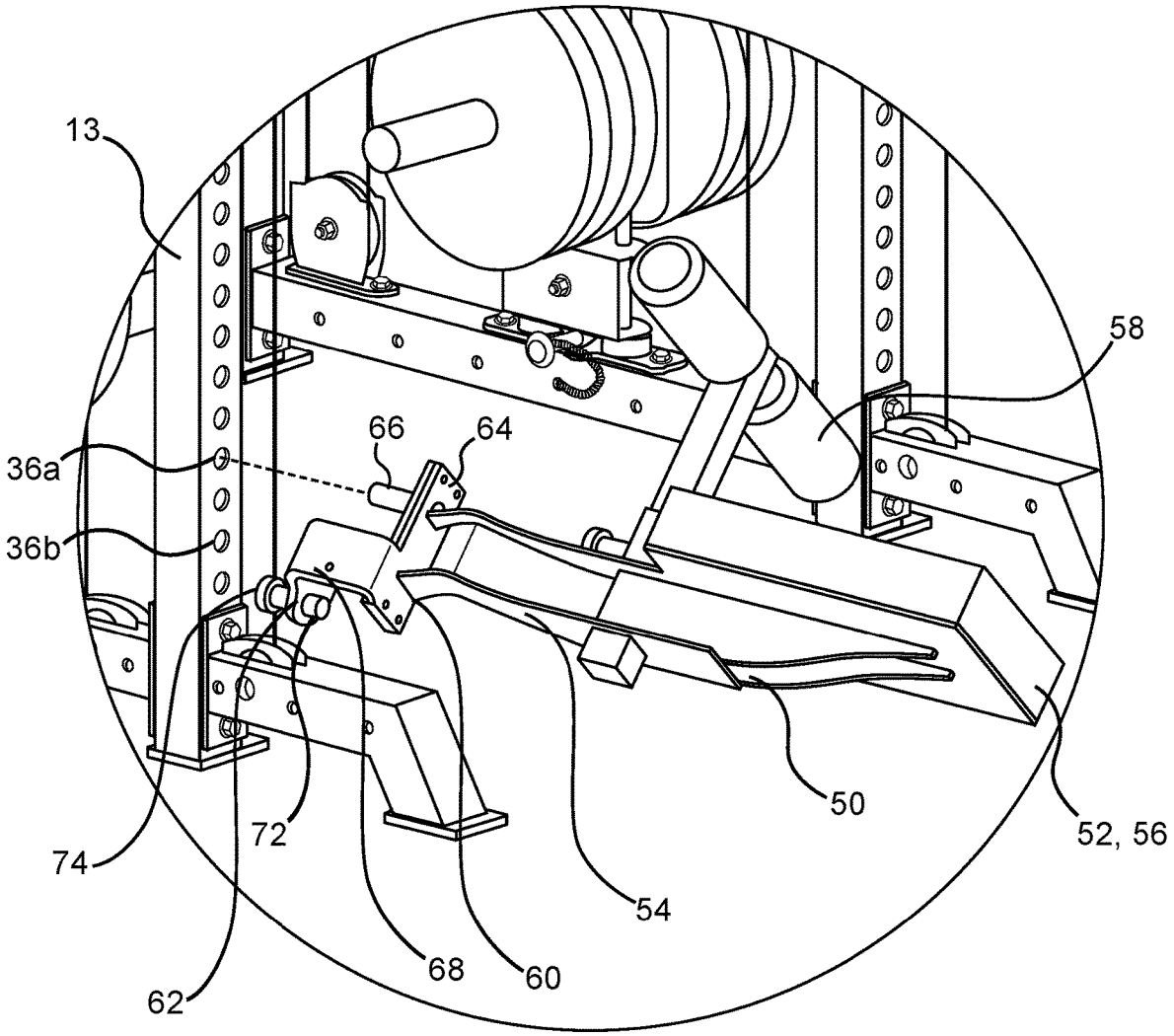
FIG. 4A is a perspective view of the attachment of FIG. 2 in the process of engaging the exercise machine of FIG. 1.
Figure 4B:
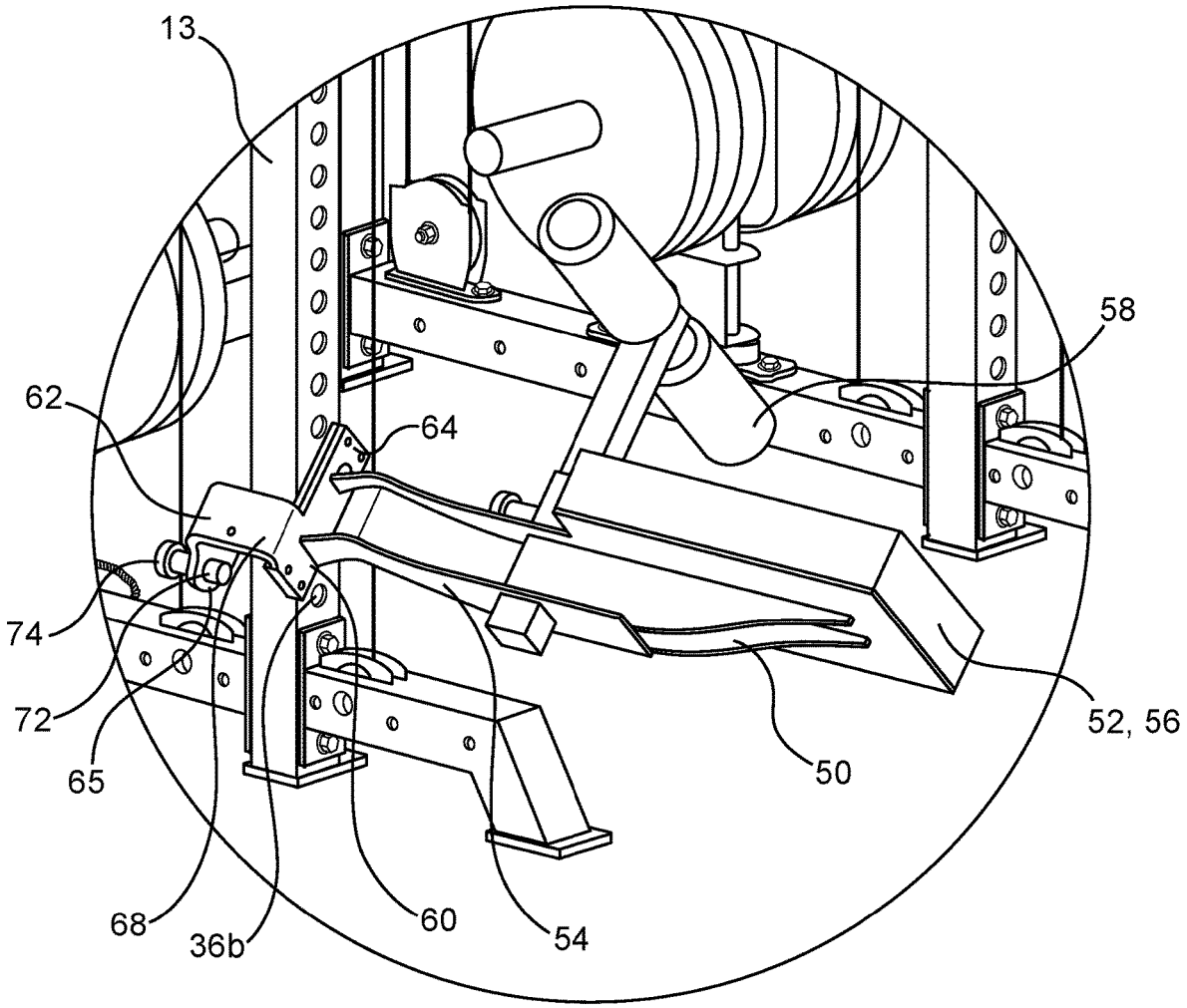
FIG. 4B is a second perspective view of the attachment of FIG. 2 in the process of engaging the exercise machine of FIG. 1.

Referring now to FIGS. 4A and 4B, the locking mechanism 62 used to lock the attachment 50 to the support frame 12 will now be described. The locking mechanism may have a first plate 64 extending upward from the distal end 60. A stationary locking pin 66 may extend from a face of the first plate 64 in the distal direction toward the columns 13, 15. When securing the attachment 50, the stationary locking pin 66 is received by the upper hole 36*a* on the columns 13, 15. The locking mechanism 62 may also have a safety hook 68 extending from the distal end 60 in the distal direction. The safety hook 68 is shaped so as to hook around and engage the columns 13, 15 when the attachment 50 is engaged with the exercise machine 10. The safety hook 68 may include the first plate 64. For example, if the columns 13, 15 are of a substantially square shape, then the safety hook 68 may engage with three sides of the columns 13, 15, as illustrated in FIGS. 5A and 5B. If the columns 13, 15 are of a substantially circular shape, then the safety hook may engage with approximately 75% of the circumference of the circular columns 13, 15. A movable locking pin 72 may extend from a second plate 65 of the safety hook 68. Specifically, the movable locking pin 72 may extend from a face of the second plate 65. As shown in FIG. 4A, the first plate 64 and the second plate 65 oppose each other, so that the stationary locking pin 66 and the movable locking pin 72 extend in opposite directions from their respective faces of the safety hook 68. In this configuration, the safety hook 68 may wrap around the columns 13, 15 and be tightly secured thereto by both the stationary locking pin 66 and the movable locking pin 72. The movable locking pin 72 may be received by the lower hole 36*b* on the columns 13, 15. As shown in the figures and as just described, the movable locking pin 72 is received by the lower hole 36*b* on the side of the columns 13, 15 opposite the side where the upper hole 36*a* receives the stationary locking pin 66. The movable locking pin 72 may have a gripping portion 74 for a user 5 to pull back in order to permit the locking pin 72 to have the necessary clearance from the columns 13, 15 before the movable locking pin 72 is to be released and received by the lower hole 36*b*.

In order to engage the attachment 50 with the exercise equipment 10, the attachment 50 must be turned at an angle from its upright position. This permits the stationary pin 66 to be received by the upper hole 36*a* without the safety hook 68 interfering with the columns 13, 15. The direction in which the attachment is to be turned, clockwise or counterclockwise, is determined by the configuration of the safety hook 68. The attachment 50 may be turned in a direction, so that when it is turned back to its upright position, the safety hook 68 hooks around and engages the columns 13, 15. The gripping portion 74 may be pulled back in order to permit the movable locking pin 72 to have the necessary clearance from the columns 13, 15 to allow the attachment 50 to be turned back to its upright position. When the attachment 50 is returned to its upright position, the gripping portion 74 is released, and the movable locking pin 72 may then be received by the lower hole 36*b*. While the attachment 50 is described as being engaged with the exercise equipment 10 having a support frame 12 and columns 13, 15 as described above, it is also contemplated that the attachment 50 may be used with different exercise equipment having similar support frames and columns as those described herein.

Referring now to FIG. 7, an exercise machine 10 with two users 5 utilizing two attachments 50 engaged with the support frame 12 is shown. The support frame 12 of the exercise machine 10 has multiple columns 13, 15 which can be used to engage the attachments 50. The first attachment 50 may include a seat 56 and adjustable leg rollers 58. The user 5 may sit on the seat 56. Their legs may be pressed up and against the adjustable leg rollers 58 to limit movement. While seated, the user 5 may pull the lat bar 16*a* which pulls the exercise cable 330 which is attached to the weight stack 14. The weight stack 14 provides resistance to a user's 5 movements when they pull the lat bar 16*a*. The second attachment 50 may include a foot plate 55. The user 5 may sit on a bench, chair, or other device to provide support while they rest their feet on and press their feet against the foot plate 55. While engaging the foot plate 55, the user 5 may pull an exercise handle 18*a* which pulls the exercise cable 32 attached to another weight stack 14. The weight stack 14 provides resistance to a user's 5 movements when they pull the exercise handle 18*a*.

While various aspects of the exercise machine 10 and attachment 190 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. An exercise machine, comprising:

a support frame, the support frame comprising:

a first column having opposing front and rear sides; and a second column having opposing front and rear sides;

a plurality of guide members configured to be movably mounted along the first column or the second column, wherein at least one of the plurality of guide members are configured to position an operative portion of a weight arrangement at a location along the support frame; and at least one attachment securable to the support frame by detachably mounting onto one of the first column or the second column, wherein the at least one attachment is detachably mounted onto the one of the first column or the second column simultaneously with the plurality of guide members, the at least one attachment comprising:

a first portion;

a second portion extending from the first portion; and a locking mechanism extending from the second portion, the locking mechanism comprising:

a safety hook having a first end with a first end face and a second end with a second end face, the second end face opposing the first end face;

a stationary locking pin extending from a surface of the first end face and configured to be received by the one of the first column or the second column; and a movable locking pin extending from a surface of the second end face and configured to be received by the one of the first column or the second column;

wherein when the at least one attachment is mounted onto the one of the first column or the second column, the safety hook surrounds at least a portion of the one of the first column or the second column, the surface of the first end face faces the front side of the one of the first column or the second column, the surface of the second end face faces the rear side of the one of the first column or the second column, and the stationary locking pin and the movable locking pin extend in opposing directions.

2. The exercise machine of claim 1, wherein the first portion comprises a seat.

3. The exercise machine of claim 2, wherein the first portion comprises at least one adjustable leg roller.

4. The exercise machine of claim 1 wherein the first portion comprises at least one foot plate.

5. The exercise machine of claim 1, wherein the first column and the second column each include a plurality of holes configured to receive at least a portion of the plurality of guide members and at least a portion of the locking mechanism therethrough.

6. The exercise machine of claim 5, wherein the plurality of holes are one inch in diameter.

7. The exercise machine of claim 5, wherein the movable locking pin is displaceable between a locking position and an opening position.

8. The exercise machine of claim 7, wherein upon displacing the movable locking pin from the locking position to the opening position, the stationary locking pin is received through a first hole of the plurality of holes, permitting the locking mechanism to be rotatably mounted to the one of the first column or the second column.

9. The exercise machine of claim 8, wherein upon rotatably mounting the locking mechanism to the one of the first column or the second column, the movable locking pin is displaced from the opening position to the locking position and received through a second hole of the plurality of holes, thereby securing the locking mechanism to the one of the first column or the second column.

10. The exercise machine of claim 9, wherein the movable locking pin comprises a gripping portion configured to permit a user to displace the movable locking pin between the locking position and the opening position.

11. The exercise machine of claim 1, wherein the movable locking pin is displaceable within and irremovable from the second end of the safety hook.

12. The exercise machine of claim 1, wherein the first column opposes the second column by at least 40 inches.

13. The exercise machine of claim 1, wherein the plurality of guide members comprises a first J-hook movably mounted to the first column and a second J-hook movably mounted to the second column.

14. The exercise machine of claim 13, wherein the weight arrangement comprises:

a barbell; and a plurality of weight plates configured to be slidably mounted to the barbell, wherein at least a portion of the barbell is received on the first J-hook and the second J-hook.

15. The exercise machine of claim 1, wherein the weight arrangement comprises:

a handle;

an exercise cable having a first end and a second end, the first end being connected to the handle and the second end being connected to a portion of the support frame; and at least one movable weight rack operatively connected to the exercise cable, wherein, upon pulling the handle, the at least one movable weight rack moves a distance, and wherein the plurality of guide members position the handle and exercise cable at a desired location along the first column or the second column.

16. An attachment configured to be detachably mounted onto a column of an exercise machine, the column having opposing front and rear sides, the attachment comprising:

a first portion configured to be engaged by a user;

a second portion extending from the first portion; and a locking mechanism extending from the second portion, the locking mechanism comprising:

a safety hook having a first end with a first end face and a second end with a second end face, the second end face opposing the first end face;

a stationary locking pin extending from a surface of the first end face and configured to be received by the column; and a movable locking pin extending from a surface of the second end face and configured to be received by the column;

wherein when the attachment is mounted onto the column, the safety hook surrounds at least a portion of the column, the surface of the first end face faces the front side of the column, the surface of the second end face faces the rear side of the column, and the stationary locking pin and the movable locking pin extend in opposing directions.

* * * * *